US010914306B2

(12) United States Patent
Jaeger

(10) Patent No.: US 10,914,306 B2
(45) Date of Patent: Feb. 9, 2021

(54) STATOR ASSEMBLY FOR A PROGRESSIVE CAVITY PUMP OR A PROGRESSIVE CAVITY MOTOR AS WELL AS METHOD FOR MANUFACTURING AND REPAIRING THE SAME

(71) Applicant: Arnold Jaeger Holding GmbH, Hannover (DE)

(72) Inventor: Sebastian Jaeger, Hannover (DE)

(73) Assignee: Arnold Jaeger Holding GmbH, Hannover (DE)

( * ) Notice: Subject to any disclaimer, the term of this patent is extended or adjusted under 35 U.S.C. 154(b) by 280 days.

(21) Appl. No.: 16/027,821

(22) Filed: Jul. 5, 2018

(65) Prior Publication Data

US 2020/0011325 A1 Jan. 9, 2020

(51) Int. Cl.

| | |
|---|---|
| ***F04C 2/107*** | (2006.01) |
| ***F03C 2/08*** | (2006.01) |
| ***F01C 1/10*** | (2006.01) |

(52) U.S. Cl.

CPC ..... *F04C 2/1075* (2013.01); *F01C 1/101* (2013.01); *F03C 2/08* (2013.01); *F04C 2/1071* (2013.01); *F04C 2230/60* (2013.01); *F04C 2230/80* (2013.01); *F04C 2240/10* (2013.01)

(58) Field of Classification Search

CPC .. F04C 2/1071; F04C 2/1075; F04C 2230/80; F04C 2230/60; F04C 2240/10; F04C 13/008; F01C 1/01; F03C 2/08

USPC ..... 418/48

See application file for complete search history.

(56) References Cited

U.S. PATENT DOCUMENTS

| | | | | |
|---|---|---|---|---|
| 4,585,401 | A * | 4/1986 | Baldenko | E21B 4/02 418/5 |
| 4,682,797 | A * | 7/1987 | Hildner | F16L 47/16 285/40 |
| 5,971,443 | A * | 10/1999 | Noel | E21B 17/043 285/94 |
| 6,968,618 | B2 * | 11/2005 | Cook | E21B 17/042 285/333 |
| 2003/0003000 | A1 * | 1/2003 | Shepherd | F04C 2/1073 417/410.3 |
| 2007/0071921 | A1 * | 3/2007 | Coulas | C23C 4/02 428/34.4 |
| 2010/0098569 | A1 * | 4/2010 | Robisson | F04C 13/008 418/48 |
| 2011/0116959 | A1 * | 5/2011 | Akbari | F04C 2/1075 418/48 |

(Continued)

*Primary Examiner* — Charles G Freay

(74) *Attorney, Agent, or Firm* — Collard & Roe, P.C.

(57) ABSTRACT

A stator assembly for a progressive cavity pump or a progressive cavity motor includes connectors for connecting functional elements and at least one stator, the stator including an outer pipe as well as a lining subject to wear which is disposed inside the outer pipe, the at least one stator being disposed between the connectors such that a cavity extending across the entire stator assembly for housing a rotor is created. Between at least one of the connectors and at least one stator adjacent thereto and/or between adjacent stators an adhesion region is provided, whereby in the adhesion region an adhesive is disposed in such a way that between the at least one connector and the at least one stator adjacent thereto and/or between said respectively adjacent stators a substance-to-substance connection is created.

14 Claims, 2 Drawing Sheets

(56) References Cited

U.S. PATENT DOCUMENTS

2014/0035280 A1* 2/2014 Shand ..... F16L 13/103
285/291.1

* cited by examiner

STATOR ASSEMBLY FOR A PROGRESSIVE CAVITY PUMP OR A PROGRESSIVE CAVITY MOTOR AS WELL AS METHOD FOR MANUFACTURING AND REPAIRING THE SAME

BACKGROUND OF THE INVENTION

1. Field of the Invention

The invention relates to a stator assembly for a progressive cavity pump or for a progressive cavity motor. The invention further relates to a method for generating such a stator assembly as well as a method for repairing such a stator assembly.

2. Description of the Related Art

Stator assemblies of this type comprise connectors and a stator disposed in-between whereby the connectors are provided for connecting the stator to further functional elements, for example, housing parts of the drive. Thus, the connectors make for a suitable transition between the stator and the respective functional element. In order to guarantee secure operation the connection between the connectors and the stator situated in-between must be chosen accordingly. To that end, known concepts are, for example, a connection via a welding joint and/or a screw thread.

The stator itself comprises a continuous and coiled cavity formed by a lining, for example elastomer lining, inside which an eccentrically mounted rotor revolves, said rotor also protruding through the connectors. By means of the revolution of the rotors it is possible to forward a medium fed in via one of the connectors through the cavity of the stator towards the other connector to be dispensed there. This forwarding process wears the material of the lining. This leads to wear of the stator which needs to be replaced after a certain period of time. The connectors, too, may wear or be damaged and may, therefore, need to be replaced.

Hereby, it is a disadvantage that in the event of wear of the stator or the lining or the connectors it is necessary to either replace the entire stator assembly including the connectors or it requires a huge effort to separate the stator from the connector. This complicates the repair procedure. Even the generation of a stator assembly with a secure connection between the connector and the stator requires a lot of effort.

SUMMARY OF THE INVENTION

Therefore, it is the object of the invention to provide a stator assembly which is easy to manufacture and to repair and which also guarantees secure operation. It is a further object to define a method for generating and repairing such a stator assembly.

This task is solved by a stator assembly according to one aspect of the invention as well as a method according to further aspects of the invention. Preferred further developments are specified below.

Thus, according to the invention, an adhesion region is provided between at least one of the connectors and at least one stator adjacent thereto and/or between adjacent stators of the stator assembly, whereby in the adhesion region an adhesive is disposed in such a way that between the at least one connector and the at least one stator adjacent thereto and/or between the respective adjacent stators a substance-to-substance bond is created.

Thus, the invention recognizes that in a stator assembly for a progressive cavity pump or a progressive cavity motor a secure connection between the connectors for connecting functional elements and at least one stator or between stators can be formed in a simple manner. Hereby, the adhesive is easy to apply and to activate and can also be undone easily so as to create a reversible connection.

This allows the wearing component in the stator assembly, i.e. the stator which comprises an outer pipe as well as a lining subject to wear and disposed inside the outer pipe or surrounded by it respectively, to be replaced in a simple manner when it has reached its wear limit. Advantageously, the connector which is often made from a very high quality and high-strength material may then be re-used. But even the connector itself which may, likewise, wear or be damaged may be replaced in a simple manner here.

Then, a reworked or a new stator or a reworked or a new connector can then be provided so as to form again, together with the other non-perished components, a stator assembly with an adhesive connection. Thus, advantageously, the stator assembly may be renewed several times without having to also replace the non-perished parts, i.e. the connectors or yet un-worn stators. These may be reused minimizing the expenditure and producing less waste. Hereby, the use of the adhesive bears the advantage that this can be removed virtually without residue so that there will be no problems e.g. by tilting or blocking upon re-assembly.

Hereby, the wear of the stator is caused by the fact that a driven rotor is housed in a cavity extending throughout the entire stator assembly which serves to forward a medium through the stator. Hereby, the forwarded medium causes wear on the lining, in particular elastomer lining, of the stator. This must be replaced when it has reached a certain wear limit in order to continue to guarantee the operation of the stator assembly.

A preferred further development provides for providing, in addition to the adhesive region, a screw thread region, for forming a positive locking and force-fit connection, between at least one of the connectors and at least one stator adjacent thereto and/or between the respective adjacent stators.

Accordingly, advantageously, a screw connection is formed acting as an additional lock. This may serve for securing a connection both during operation and during assembly, in particular, for holding the two components while the adhesive connection is being formed. Hereby, the adhesive connection leads to the forces between the respective connector and the stator and/or between the stators being transferred not fully via the screw connection but mostly via the adhesive connection. This can avoid damage to the screw thread and/or the screw connection becoming loose. Thus, the connection between the respective components becomes more reliable and damage is avoided so that e.g. the connectors may be re-used.

According to a further preferred embodiment, between at least one of said connectors and at least one stator adjacent thereto and/or between the respective adjacent stators, completely circumferentially, a falling or rising edge is formed on which said adhesion region and said screw thread region are disposed fully or at least in part. This enables a connection extending across a certain region between the respective so that a secure connection can be guaranteed permanently even when subjected to forces. This may also simplify assembly.

Preferably, the adhesive region and the screw thread region do not overlap on the edge. Hereby, force can be exerted or transferred respectively between the components via separate regions. Thereby, the force acting on the screw thread can be markedly reduced, provided that a suitable arrangement of the adhesive region on the edge ensures that forces between the two components act mainly on the adhesion region. Hereby, the screw thread may act as a securing connection in addition to the adhesion connection during assembly and/or in operation permanently, without any compromise to the adhesion connection in operation. However, according to one embodiment, the adhesion connection may also protrude as far as into the screw thread region at least in part in order to additionally prevent the screw connection from becoming loose.

In accordance with a preferred embodiment, the adhesion region extends across the entire circumference between at least one of the connectors and at least one stator adjacent thereto and/or between the respective adjacent stators. Hereby, a continuous and, thereby, durable and reliable substance-to-substance connection can be created.

In accordance with a preferred embodiment, in the adhesion region between the stator and the connector and/or in the adhesion region between the respective stators a feed chamber is provided in which the adhesive is disposed. Thus, advantageously, an area is defined in which a defined amount of the adhesive is fed in and can be held so that upon assembly the adhesive is not forced out of the interspace between the components thereby making possible the creation of a reliable and durable substance-to-substance connection.

To that end, according to one embodiment, the feed chamber is connected via a duct to a feed opening for feeding in the adhesive into the adhesion region during assembly. Thus, the adhesive may be fed in even after the assembly of the individual components, for example, after closing the screw thread. Thus, the adhesion process may happen even after a long period of time without compromising the quality or the adhesive effect of the adhesive if the adhesive is not activated or cured until then. Thus, the stator assembly may first be fully assembled and subsequently, after a certain period of time, finished by means of the adhesive without compromising the substance-to-substance connection.

In principle, however, the adhesive may be applied even prior to assembling the components so that the adhesive after assembly is located in the feed chamber and can be activated or cured respectively.

To make sure that the adhesive remains in the feed chamber, preferably, the feed chamber may be sealed by means of caskets.

In accordance with a preferred embodiment, a wall of the outer pipe of the stator is thinner than a wall of the connector. This takes into accountancy the fact that the stator is a component subject to wear and as such is replaced upon reaching its wear limit. The outer pipe may be made thinner than the connector, in particular, owing to its shorter life span since, in contrast thereto, the connector is being re-used. This can save cost and material. In principle, it is also possible, however, to use equal wall thicknesses for the stator and the connectors so as to simplify the manufacturing of these parts.

In accordance with a preferred embodiment, the outer pipe exhibits a lower strength than the connector. For example, the outer pipe can be made from construction steel having a yield strength in the range of about 350 $N/mm^2$ or a steel of comparable strength and the connector can be made from a heat treatment steel of higher strength having a yield strength in the range of about 900 $N/mm^2$ or a steel of comparable strength. Advantageously, this allows the use of a material of lower value for the outer pipe which is designed only to fulfil its function—holding the lining—throughout a short life span. In contrast thereto, the connector is made of a material having a continuous high resilience and can thus be re-used after a stator has been replaced.

To enable replacement, preferably, an adhesive is used that can be cured or activated with a time delay and/or is detachable by being treated with heat. This enables a simple generation and/or repair of the stator assembly because no complicated procedures are required for generating or detaching respectively of the substance-to-substance connection.

Thus, according to the invention, for generating a stator assembly as described, firstly, connectors and at least one stator are supplied. Subsequently, the connectors are assembled with the at least one stator in such a way that the at least one stator is disposed between the connectors and a cavity of the stator assembly for housing the rotor is generated. Subsequently, the adhesive is cured with a time delay in an adhesion region between at least one of the connectors and at least one stator adjacent thereto and/or between adjacent stators so as to generate a substance-to-substance adhesive connection between at least one of the connectors and at least one stator adjacent thereto and/or between adjacent stators and thereby finish the stator assembly.

Hereby, as described above, the adhesive may be applied before and/or after the assembling of the connectors with the at least one stator in the adhesion region, in particular, into a feed chamber.

For repairing such a stator assembly the invention provides for detaching the existing adhesive connection between as least one of the connectors and at least one stator adjacent thereto and/or between adjacent stators and to correspondingly remove the detached stator and/or the connectors and, if applicable, to rework them. Subsequently, using a new or a reworked stator and/or a new or reworked connector a new stator assembly can be generated as described above.

BRIEF DESCRIPTION OF THE DRAWINGS

The invention is subsequently illustrated by means of embodiment examples. It is shown in.

DETAILED DESCRIPTION OF THE PREFERRED EMBODIMENTS

Figure 1:
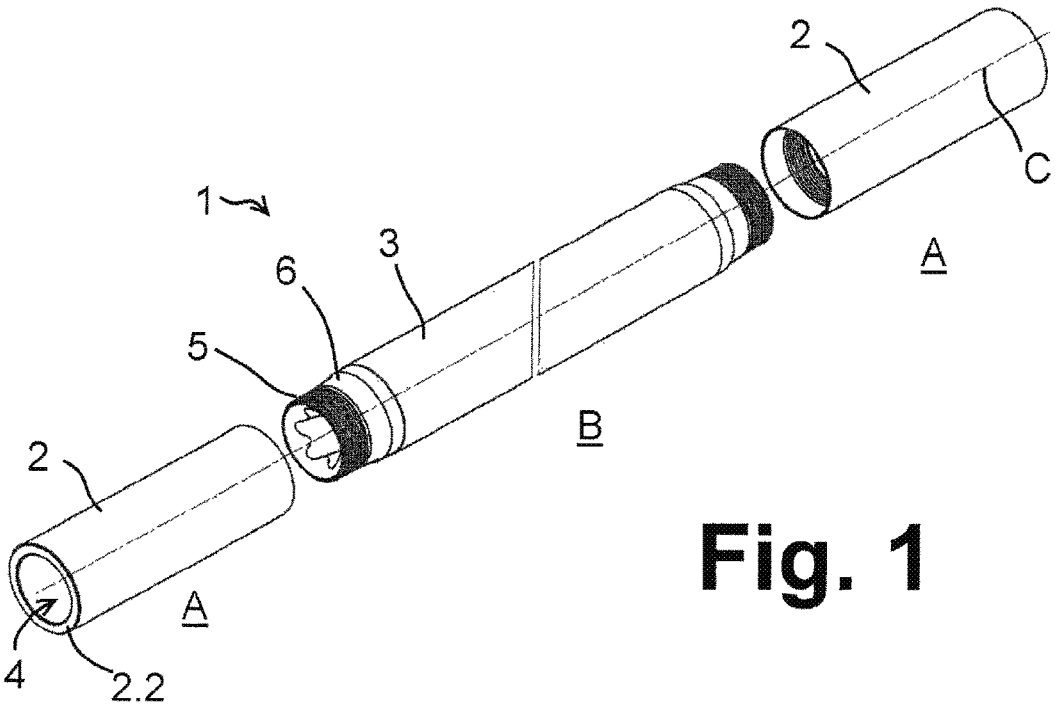
FIG. 1 a stator assembly consisting of two connectors as well as one stator.

FIG. 1 shows a stator assembly 1 for a progressive cavity pump or for a progressive cavity motor, operating in accordance with the Moineau principle, consisting of two connectors 2 and coiled stator 3 disposed in-between. The connectors 2 (terminals) each form an outer section A, and the stator 3 forms a middle section B of the stator assembly 1. The middle section B of the stator assembly 1 may be formed by merely one stator 3 (s. FIG. 1) or by several adjacent stators so as to be able to adapt the length of the middle section B as desired.

Figure 2:
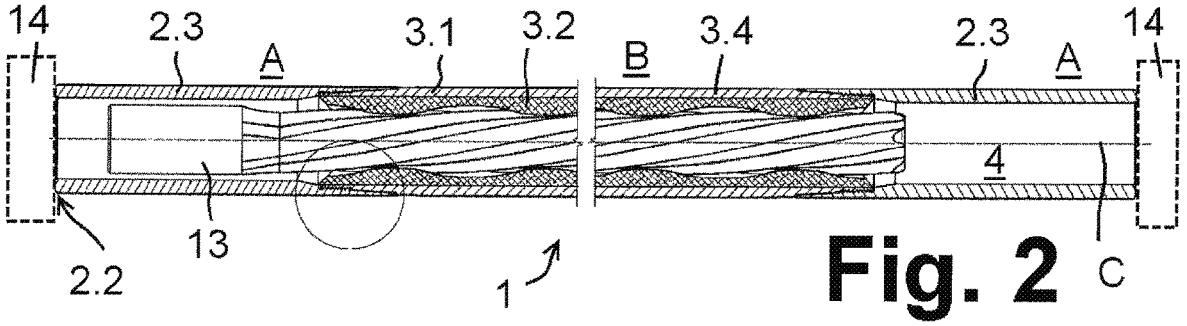
FIG. 2 a section view of the stator assembly according to FIG. 1.

Normally, inside a cavity 4 of the stator assembly 1, the central axis of which is designated in FIG. 1 as C, an eccentrically mounted rotor 13 is pivoted (see FIG. 2). In order to attain a rotation of the rotor 13 in the stator assembly 1 the stator assembly 1 is connected, via one of the connectors 2, to further housing parts or functional elements 14 respectively leading to a drive mechanism, said functional elements being indicated by dotted lines in FIG. 2 and inside of them e.g. the corresponding drive elements for the rotor 13 being disposed. Via this connector 2 it is also possible to feed in material. The respectively other connector 2 serves to output the medium forwarded by the stator 3 or, respectively, as a connection to further functional elements 14 of the progressive cavity pump or the progressive cavity motor.

According to the sectional view in FIG. 2, the at least one stator 3 in the middle section B of the stator assembly 1 comprises an outer pipe 3.1 on the inside of which a lining 3.2 is disposed. The outer pipe 3.1 is usually made from a relatively hard material and the lining 3.2 is made of an elastomer. Hereby, the lining 3.2 is formed in the way of a multiple helical steep thread and defines the cavity 4 in the middle section B. This cavity 4 also houses the rigid rotor 13 which, likewise, is shaped in the way of a helical steep thread. In principle, it is possible, instead of a coiled or thread-type design of the lining 3.2 and the Rotor 13, to use another cylindrical design of both components. The lining 3.2 is connected to the outer pipe 3.1 such that the lining 3.2 cannot distort in relation to the outer pipe 3.1.

By means of rotating the rotors 13 in the middle section B of the stator assembly 1 it is possible to forward a medium through the Stator 3. Hereby, the medium forwarded causes, by virtue of its friction, the stator 3 or, respectively, the lining 3.2 made of the elastomer to be wear or abrade respectively so that the corresponding stator 3 is to be replaced after a certain period of time in order to continue to safely and effectively guarantee the drive effect or the forwarding effect respectively of the progressive cavity pump via the stator assembly 1. Also, the connectors 2 of the stator assembly 1 may wear of be damaged so that, depending on the situation, they are to be replaced, too.

Figure 3A:
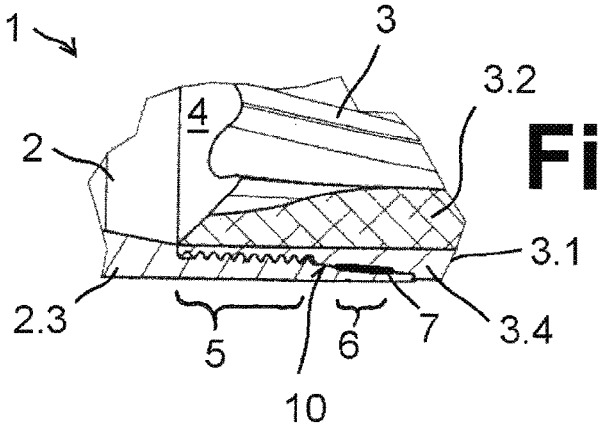
FIG. 3*a*, 3*b*, 3*c* detail views of the transition between one of the connectors and the stator according to FIG. 2.
Figure 3B:
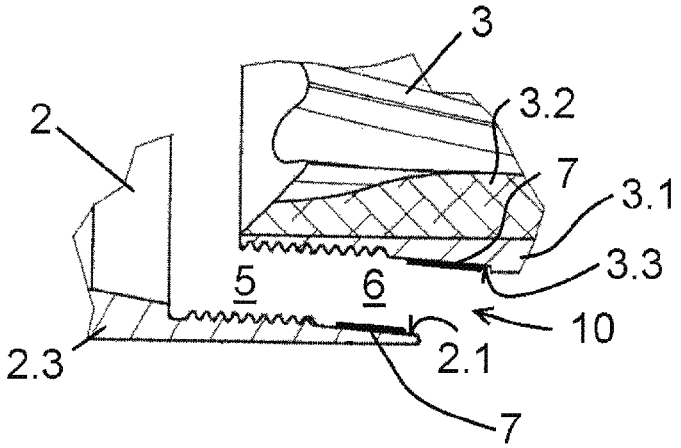
Figure 3C:
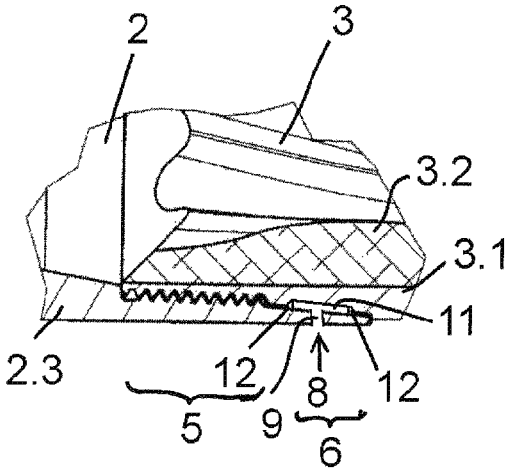

In order to enable such replacement of the Stators 3 and/or the connectors 2 in a simple manner, according to the detailed views in FIGS. 3*a*, 3*b* and 3*c*, a screw thread region 5 and an adjacent adhesion region 6 are formed between the respective connector 2 and the corresponding Stator 3 on a sloped edge 10, these regions each making a connection between the two elements 2, 3. Both the screw thread region 5 and the adhesive region 6 run around the entire circumference of the stator assembly 1. In this embodiment, the screw thread region 5 has a wider axial extension than the adhesive region 6. In principle, however, the adhesion region 6 may even be longer than the screw thread region 5.

The screw thread region 5 and the adhesion region 6 may also be interchanged such that, when viewed from the side of the connector 2, the adhesion region 6 is disposed first and thereafter the screw thread region 5.

Via the screw thread region 5 the respective Stator 3 can be screwed together, in a known manner, with the respective connector 2 so as to create a combination of positive fit and force closure between the two. In order to avoid undesired exertion of force on the screw thread region 5 when the pump or the motor respectively is in operation and in order to additionally secure the connection between the two components the adhesion region 6 is provided. In this a adhesive 7 is placed around the entire circumference so that, in addition, a substance-to-substance connection can be created between the stator 3 and the corresponding connector 2. Thus, the stator 3 is secured to the connector 2 by means of a force closure and a positive fit (screw thread region 5) as well as a substance-to-substance connection (adhesion region 6). Hereby, the adhesive 7 may be, for example, a multi-component polymer resin.

In order to create the adhesive connection in the adhesion region 6, according to one embodiment (FIG. 3*a*, 3*b*), the adhesive 7 can be applied in the adhesion region 6 onto an outer edge 3.3 of the stator 3 and/or an inner edge 2.1 of the connector 2 and possibly also in certain regions of the screw thread region 5 prior to the stator 3 being screwed with the connector 2 (see FIG. 3*b*). Subsequently, the connector 2 is screwed onto the stator 3, and the applied adhesive 7 can then cure with a time delay as pre-adjusted accordingly. This causes a linking to occur by virtue of which the connector 2 is substance-to-substance connected to the stator 3 in the adhesion region 6.

According to an alternative embodiment, which is shown in FIG. 3*c*, in the adhesion region 6 a feed opening 8 may protrude through the connector 2 whereby the adhesive 7 can be inserted through the feed opening 8 and through a duct 9 into the adhesion region 6 between the inner edge 2.1 of the connector 2 and the outer edge 3.3 of the stator 3. Hereby, the inner edge 2.1 of the connector 2 as well as the outer edge 3.3 of the stator 3 may be designed in such a way that in the screwed-in position of the stator 3 with the connector 2 a feed chamber 11 having a thickness of, for example between 0.1 and 1.5 millimetres between the two components 2, 3 is created. This can guarantee that the adhesive 7 can enter the full circumference of the adhesion region 6 thereby generating a substance-to-substance connection over the entire circumference between the stator 3 and the connector 2.

To allow air to escape from the adhesion region 6 or the feed chamber 11 respectively when adhesive 7 is inserted into the feed opening 8, an additional feed opening (not shown) connected to the feed chamber 11 is provided through which the air can escape. To further cause the feed chamber 11 to be sealed off to thereby allow the adhesive 7 to be applied under pressure as well as to prevent leakage of the applied adhesive 7 from the feed chamber 11, gaskets 12 are provided which seal off the feed chamber 11 laterally across the entire circumference.

The adhesion region 6 as well as the adhesive 7 are dimensioned such that in operation when forces are exerted on the stator 3 or on the connector 2 respectively a large portion of such forces are transferred via the adhesion region 6 and the adhesive 7 onto the respectively adjacent component 2, 3. This reduces the forces exerted on the screw thread region 5. This can avoid damage to the screw thread region 5 when the progressive cavity pump or the des progressive cavity motor respectively is in operation because the main power transfer is shifted from the screw thread region 5 to the adhesion region 6. At the same time, a detachment of the connector 2 from the stator 3 by inadvertent twisting of the components 2, 3 against each other can be avoided. Thus, a connection between the two components 2, 3 can be guaranteed in a simple manner.

In order to enable replacement of the at least one stator 3 subject to wear or also the connectors 2 in such an design of the stator assembly 1, an adhesive 7 is provided whose substance-to-substance effect can be reversed at a later point in time. This can be achieved, for example, by means of a corresponding heat treatment in the adhesion region 6 at high temperatures by means of which the 7 becomes detached again. Subsequently, the connector 2 can be detached from the stator 3 by twisting it accordingly against the same. The stator 3 and/or the connectors 2 removed can then be re-worked or replaced accordingly and be screwed onto the connector 2 or the stator 3 respectively and substance-to-substance connected thereto via the adhesive 7 in the way described above. Hereby, the adhesive 7 is pre-adjusted such that temperatures of up to 200° prevailing in operation do not cause the substance-to-substance connection to be detached.

This is of advantage because the connector 2 which is not subject to wear can be made of high quality and from a very hard material, for example a heat treatment steel of higher strength having a yield strength in the range of about 900 $N/mm^2$, to guarantee a secure and durable connection to the respective adjoining component. In contrast thereto, the stator 3 which is subject to wear anyway can be made with such a value or rigidity respectively or, respectively, at such expenditure as takes into account the prevailing wear of the linings 3.2 and thus the actual life-span of the stator 3. For example, a wall 3.4 of the outer pipe 3.1 outside the adhesion region 6 and the screw thread region 5 may be made thinner than a wall 2.3 of the connector 2 outside the adhesion region 6 and the screw thread region 5. Also, construction steel having a yield strength in the range of about 350 $N/mm^2$ may be chosen as the material of the outer pipe 3.1 since this is more affordable and exhibits a lower rigidity that the material of the connector 2.

This allows the outer pipe 3.1 of the stator 3 actually subject to wear to be manufactured cheaper in total than the connector 2 which, however, is no disadvantage because the main load acts on the lining 3.2 and the outer pipe 3.1 merely serves to keep the lining 3.2 in place until this is perished. Then, the adhesion and the screw connection via the respective regions 5, 6 allows a simple replacement while, at the same time, a secure connection between the connector 2 and the Stator 3 is guaranteed.

According to an embodiment not shown here, the middle section B may comprise several stators 3 which may be joined together in the same way as described in connection with the FIGS. 2, 3*a*, 3*b*, 3*c*. Each stator 3 can then be connected via a correspondingly designed screw thread region 5 and an adhesion region 6 with an adjacent stator 3 with complementary screw thread region 5 and adhesion region 6. This allows also stators 3 in the middle section B to be detachably connected to each other in a simple manner via a screw connection and an adhesion. When a deterioration or damage is detected in only one of the stators 3 of the middle section B, this can easily be replaced by detaching the adhesive 7 as well as the screw connection. Thus, a simple replacement is also possible in the event of defects only in a certain region or regional wear in merely one of the stators 3.

For connecting the connector 2 to the respective adjacent functional element disposed externally, a screw thread may be included also in an end region 2.2 of the connector 2 by means of which the connector 2 can be screwed onto the respective adjacent functional element. This screw connection, too, may be secured by an additional adhesion connection or, respectively, substance-to-substance connection.

In principle, all of the above-described embodiments may be designed even without a screw thread region 5 or, respectively, without a screw connection between the stator 3 and the connector 2 or, respectively, between individual stators 3. Nevertheless, for assembling the stator assembly 1 the connector 2 needs to be placed on the stator 3 and, subsequently, the adhesion connection must be created, as described above, with the adhesive 7 in the adhesion region 6. Then, according to this embodiment, no additional securing screw connection is provided whereby a sufficient connection between the two components 2, 3 can be created by the adhesion connection.

Figure 4:
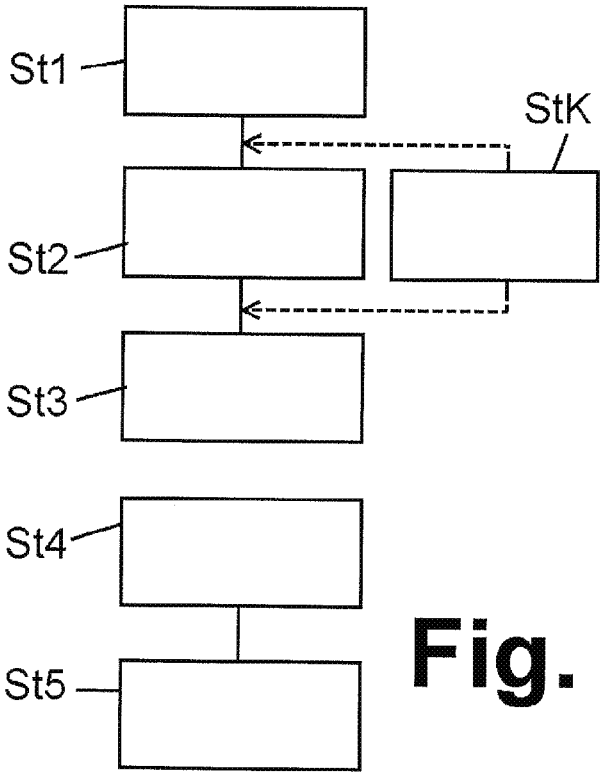
FIG. 4 a flow chart of the method according to the invention.

According to FIG. 4, the stator assembly 1 can be manufactured and/or repaired, for example, as follows. In a first step St1 at least one connector 2 as well as at least one stator 3 are provided. Subsequently, the two supplied components 2, 3 are assembled in a second step St2, this being done either by screwing or by stacking. Depending on the type of the adhesion connection the adhesive 7 is inserted into the adhesion region 6 in an intermediate step StK either prior to the second step St2 (see FIG. 3*a*, 3*b*) or after the second step St2 (see FIG. 3*c*). Then, in a third step St3 the inserted adhesive 7 is cured with a time delay so that the screwed or stacked components 2, 3 are connected substance-to-substance.

In the event that a stator assembly 1 made in such a way, the substance-to-substance connection, if desired, can be detached again in a fourth step St4 by means of a heat treatment of the adhesion region 6. In a fifth step St5 the stator 3 and/or one and/or both connectors 2 can be removed and re-worked or replaced. Subsequently, after the steps St1 through St3 a repaired stator assembly 1 can be created using the existing connector(s) 2 or, respectively, the existing stator 3 and a re-worked or a replaced Stator 3 or connector 2 respectively.

LIST OF REFERENCE NUMERALS (PART OF THE DESCRIPTION)

1 stator assembly
2 connector
2.1 inner edge of connector 2
2.2 end region
2.3 connector wall 2
3 stator
3.1 outer pipe of stator 3
3.2 lining
3.3 outer edge of stators 3
3.4 outer pipe wall 3.1
4 cavity
5 screw thread region
6 adhesion region
7 adhesive
8 feed opening
9 duct
10 edge
11 feed chamber
12 gasket
13 rotor
14 functional elements
A outer section
B middle section
C central axis
St1, St2, St3, St4, St5, StK procedure steps

What is claimed is:

1. A stator assembly for a progressive cavity pump or a progressive cavity motor, with connectors for connecting functional elements and at least one stator, said stator comprising an outer pipe as well as a lining disposed inside said outer pipe and being subject to wear, said least one stator being disposed between said connectors so that a cavity extending through the entire stator assembly is formed for housing a rotor, wherein between at least one of said connectors and at least one stator adjacent thereto and/or between adjacent stators an adhesion region is provided whereby an adhesive is disposed inside said adhesion region in such a way that the adhesive physically connects said at least one connector and said at least one stator adjacent thereto and/or the adhesive physically connects said respective adjacent stators, and wherein said outer pipe of each of said at least one stator exhibits a lower tensile strength and yield strength than each of said connectors.

2. The stator assembly according to claim 1, wherein, in addition to the adhesive region between at least one of said connectors and at least one stator adjacent thereto and/or between adjacent stators, a screw thread region is disposed between at least one of said connectors and at least one stator adjacent thereto and/or between the respective adjacent stators for forming a positive locking force-fit connection.

3. The stator assembly according to claim 2, wherein, between at least one of said connectors and at least one stator adjacent thereto and/or between the respective adjacent stators, completely circumferentially, a falling or rising edge is formed on which said adhesion region and said screw thread region are disposed at least in part.

4. The stator assembly according to claim 2, wherein said adhesion region and said screw thread region do not overlap.

5. The stator assembly according to claim 1, wherein the adhesion region extends across the entire circumference between at least one of said connectors and at least one stator adjacent thereto and/or between said respective adjacent stators.

6. The stator assembly according to claim 1, wherein in said adhesion region between said stator and said connector and/or in said adhesion region between the respective two stators a feed chamber is provided in which said adhesive is disposed.

7. The stator assembly according to claim 6, wherein said feed chamber is connected via a duct to a feed opening for feeding in said adhesive into said adhesion region during assembly.

8. The stator assembly according to claim 6, wherein said feed chamber is sealed by means of gaskets.

9. The stator assembly according to claim 1, wherein one wall of the outer pipe of each of said at least one stator is thinner than a wall of each of said connectors.

10. The stator assembly according to claim 1, wherein said outer pipe of each of said at least one stator is made from construction steel having a yield strength of 350 $N/mm^2$ and said connector is made from a heat treatment steel of higher strength having a yield strength of 900 $N/mm^2$.

11. The stator assembly according to claim 1, wherein said adhesive is detachable by heat treatment.

12. A method for generating the stator assembly according to claim 1 including at least the following steps:

supplying the connectors and at least one stator;

assembling said connectors with the at least one stator in such a way that said at least one stator is disposed between said connectors and a cavity of said stator assembly for housing the rotor is created;

curing an adhesive in an adhesion region between at least one of said connectors and at least one stator adjacent thereto and/or between adjacent stators so that the adhesive physically connects at least one of said connectors and at least one stator adjacent thereto and/or the adhesive physically connects adjacent stators for finishing said stator assembly.

13. The method according to claim 12, wherein said adhesive is applied into said adhesion region before and/or after the assembly of said connectors with said at least one stator.

14. A method for repairing a stator assembly including at least the following steps:

detaching the adhesive connection between at least one of said connectors and at least one stator adjacent thereto and/or between adjacent stators;

removing the detached stator and/or the at least one connector;

creating the stator assembly according to the method of claim 12 by means of supplying at least one reworked or new stator and/or of at least one reworked or new connector.

* * * * *